US009571920B2

(12) United States Patent
Cheng et al.

(10) Patent No.: US 9,571,920 B2
(45) Date of Patent: Feb. 14, 2017

(54) EXTERNAL SOUND BOX, LOUDSPEAKER MODULE WITH SAME AND ELECTRONIC DEVICE

(71) Applicant: Chiun Mai Communication Systems, Inc., New Taipei (TW)

(72) Inventors: Chuan-Hsien Cheng, New Taipei (TW); Chun-Jen Chen, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 29 days.

(21) Appl. No.: 14/582,390

(22) Filed: Dec. 24, 2014

(65) Prior Publication Data

US 2015/0189424 A1 Jul. 2, 2015

(30) Foreign Application Priority Data

Dec. 31, 2013 (CN) ..... 2013 1 0747934

(51) Int. Cl.
*H04R 1/28* (2006.01)

(52) U.S. Cl.
CPC ..... *H04R 1/2842* (2013.01); *H04R 2499/11* (2013.01)

(58) Field of Classification Search
CPC ..... H04R 1/02; H04R 1/025; H04R 1/026; H04R 1/2842; H04R 1/028; H04R 2201/021; H04R 2420/09; H04R 2499/11;H04R 2499/15; H04R 5/02; H04M 1/035
See application file for complete search history.

(56) References Cited

U.S. PATENT DOCUMENTS 8,761,432 B1 * 6/2014 Cheng ..... H04R 1/026 381/338
2007/0223762 A1 * 9/2007 Kwon ..... H04R 5/02 381/334
2009/0288911 A1 * 11/2009 Chen ..... H04M 1/035 181/199
2010/0086163 A1 * 4/2010 Lorenz ..... H04R 1/2819 381/353
2011/0042161 A1 * 2/2011 Burghardt ..... H04R 1/2842 181/148
2015/0146083 A1 * 5/2015 Kim ..... H04N 5/23209 348/360

* cited by examiner

*Primary Examiner* — Fan Tsang
*Assistant Examiner* — Angelica M McKinney
(74) *Attorney, Agent, or Firm* — Zhigang Ma

(57) ABSTRACT

An external sound box includes a connecting member and a sound box. The connecting member includes a sound passage and is selectively attachable to a surface of an electronic device to cover a sounding hole of the electronic device. The sound box is mounted to the connecting member. The sound box defines a resonant chamber communicating with the sound passage and a sounding output hole. Sound generated by the electronic device moves from the sounding hole into the sound passage and the sound box. The sounding passage and the sound box are configured so that the sound from the sounding hole resonates before exiting the sound output hole with increased volume.

17 Claims, 4 Drawing Sheets

EXTERNAL SOUND BOX, LOUDSPEAKER MODULE WITH SAME AND ELECTRONIC DEVICE

CROSS-REFERENCE TO RELATED APPLICATIONS

This application claims priority to Chinese Patent Application No. 201310747934.7 filed on Dec. 31, 2013, the contents of which are incorporated by reference herein.

FIELD

The subject matter herein generally relates to an external sound box, a loudspeaker module with the external sound box, and an electronic device having the loudspeaker module.

BACKGROUND

Electronic devices, such as mobile phones, personal digital assistants, include loudspeakers for implementing the multi-media playing function. The electronic devices commonly define receiving chambers for receiving the loudspeakers, and resonant cavities for sounds emitted by the loudspeakers to resonate. However, the volume of the loudspeaker may not be high enough or satisfy the requirements of the user.

BRIEF DESCRIPTION OF THE DRAWINGS

Implementations of the present technology will now be described, by way of example only, with reference to the attached figures.

DETAILED DESCRIPTION

Figure 1:
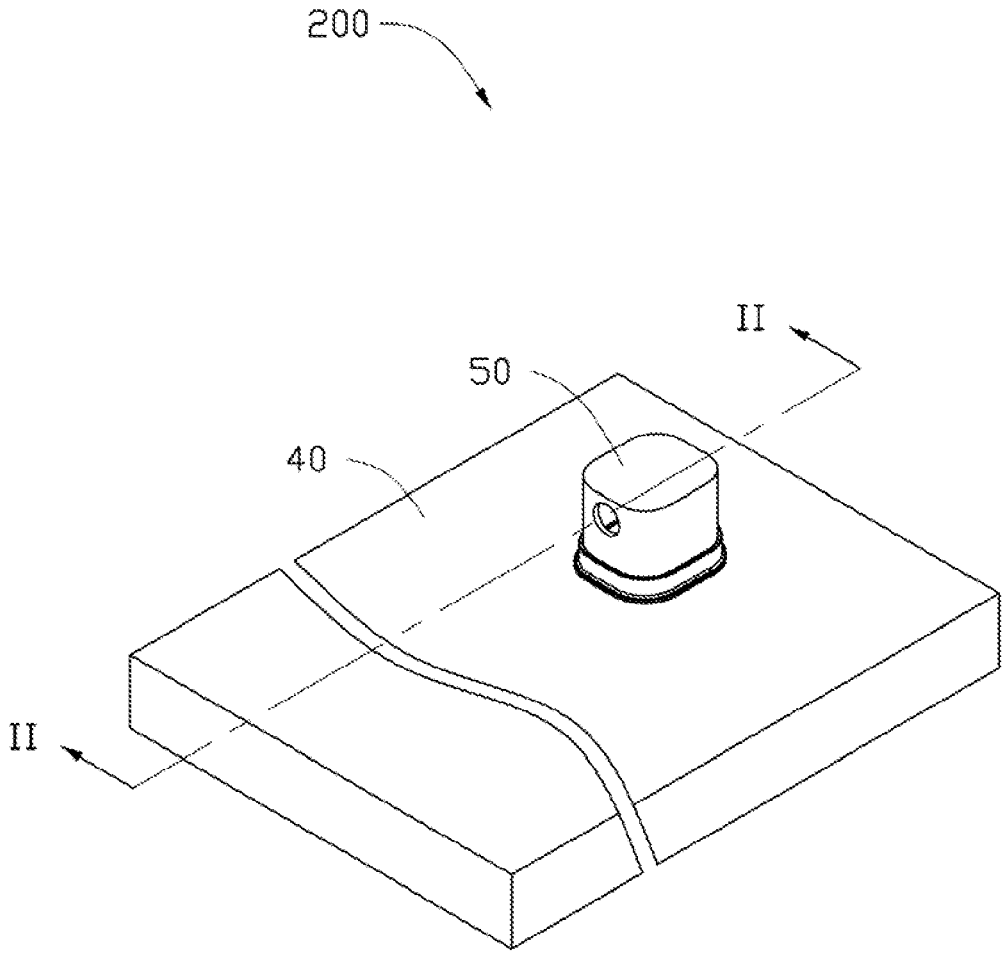
FIG. 1 is an assembled, isometric view of a first embodiment of an electronic device with a loudspeaker module.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure.

Several definitions that apply throughout this disclosure will now be presented.

The term "substantially" is defined to be essentially conforming to the particular dimension, shape or other word that substantially modifies, such that the component need not be exact. For example, substantially cylindrical means that the object resembles a cylinder, but can have one or more deviations from a true cylinder. The term "comprising" when utilized, means "including, but not necessarily limited to"; it specifically indicates open-ended inclusion or membership in the so-described combination, group, series and the like.

FIG. 1 illustrates a first embodiment of an electronic device 200. The electronic device 200 may be a mobile phone, a CD player, a MP3 player, a personal digital assistant (PDA) and the like. The electronic device 200 includes a housing 40 and a loudspeaker module 50. The loudspeaker module 50 is mounted to the housing 40 and is configured to improve a volume of sounds of the electronic device 200.

Figure 2:
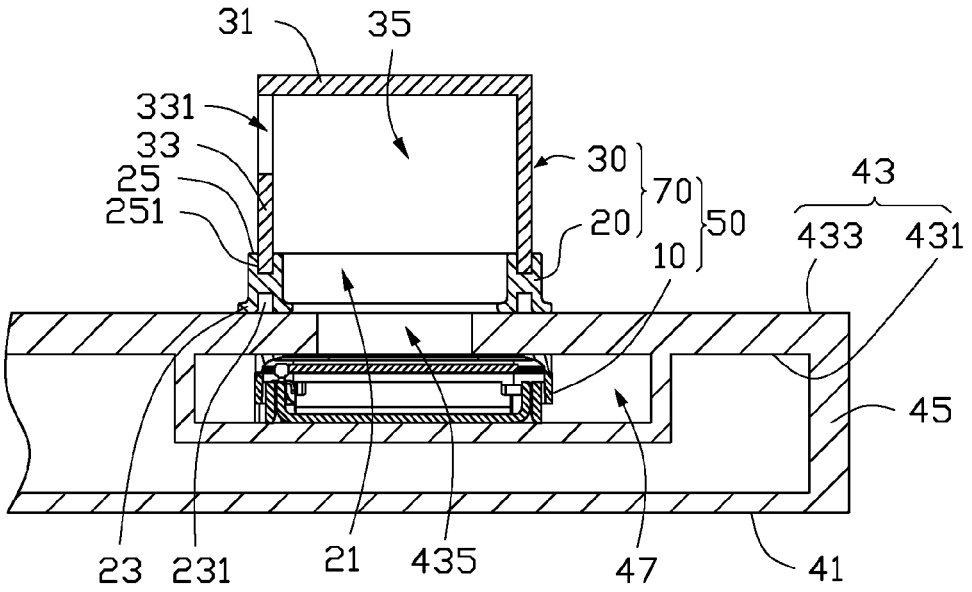
FIG. 2 is a cross-sectional view taken along line II-II of FIG. 1.

FIG. 2 illustrates that the housing 40 includes a bottom wall 41, a top wall 43, and a connecting wall 45. The top wall 43 is parallel to and spaced apart from the bottom wall 41. The connecting wall 45 is perpendicularly coupled between the outside peripheries of the bottom wall 41 and the top wall 43. The top wall 43 includes a first surface 431 and a second surface 433 opposite to the first surface 431. A receiving cavity 47 protrudes from the first surface 431 towards the bottom wall 41. The top wall 43 further defines a sounding hole 435. The sounding hole 435 communicates with the receiving cavity 47. The sounding hole 435 is configured to transmit the sounds emitted by the loudspeaker module 50 to an exterior of the housing 40.

The loudspeaker module 50 includes a loudspeaker 10 and an external sound 70. The loudspeaker 10 is received in the receiving cavity 47 and is configured to emit sounds. The external sound box 70 includes a connecting member 20 and a sound box 30. The sound box 30 is secured to the connecting member 20. The connecting member 20 and the sound box 30 are both communicated with the loudspeaker 10. Then, the sounds emitted by the loudspeaker 10 can be transmitted to the connecting member 20 and the sound box 30.

In this embodiment, the connecting member 20 is substantially a ring and is mounted to the second surface 433. A middle of the connecting member 20 defines a sound passage 21. The sound passage 21 is aligned with and communicated with the sounding hole 435. The connecting member 20 further includes a first end 23 and a second end 25 opposite to the first end 23. The first end 23 defines a mounting slot 231. The mounting slot 231 is configured to assemble the connecting member 20 to the second surface 433 of the housing 40. The second end 25 defines a receiving slot 251 for mounting the sound box 30 to the connecting member 20. In this embodiment, the connecting member 20 is made of soft material, such as rubber. Then, the connecting member 20 can be pressed on the second surface 433 of the housing 40 for preventing sounds emitted by the loudspeaker 10 from leaking.

The sound box 30 is substantially hollow and includes a base wall 31 and four sidewalls 33. In this embodiment, the base wall 31 is substantially rectangular. The four sidewalls 33 are projected along the outer periphery of the base wall 31 and are partially received in the receiving slot 251 for assembling the sound box 30 to the connecting member 20. The base wall 31 and the four sidewalls 33 further cooperatively form a resonant chamber 35. The resonant chamber 35 is aligned with the sound passage 21 and the sounding hole 435. Then, the sounds emitted by the loudspeaker 10 can transmit to the sounding hole 435 and the sound passage 21 and resonates in the resonant chamber 35 for improving the volume of the sounds transmitted to the exterior of the housing 40. A sounding output hole 331 is defined at one of the four sidewalls 33. When the sound box 30 is mounted to the connecting member 20, the sounding output hole 331 is aligned with and communicated with the resonant chamber 35 for allowing the output of sounds emitted by the loudspeaker 10 of the electronic device 200.

During assembly of the electronic device 200, the loudspeaker 10 is received in the receiving cavity 47 and is aligned with the sounding hole 435. The sound box 30 is mounted to the connecting member 20 via the four sidewalls 33 of the sound box 30 partially inserting into the receiving slot 251. In this way, the resonant chamber 35 is aligned with the sound passage 21. The sounding output hole 331 is communicated with the resonant chamber 35 and the sound passage 21. The first end 23 of the connecting member 20 is pressed so that air is exhausted from the mounting slot 231. Then, the connecting member 20 with the sound box 30 is mounted to the second surface 433 of the top wall 43 due to atmospheric pressure and for preventing sound from leaking.

In use, the sounds emitted by the loudspeaker 10 transmits to the resonant chamber 35 via the sounding hole 435 and the sound passage 21, resonates in the resonant chamber 35, and is output from the sounding output hole 331 to improve the volume of the sound transmitted to the exterior of the housing 40.

Figure 3:
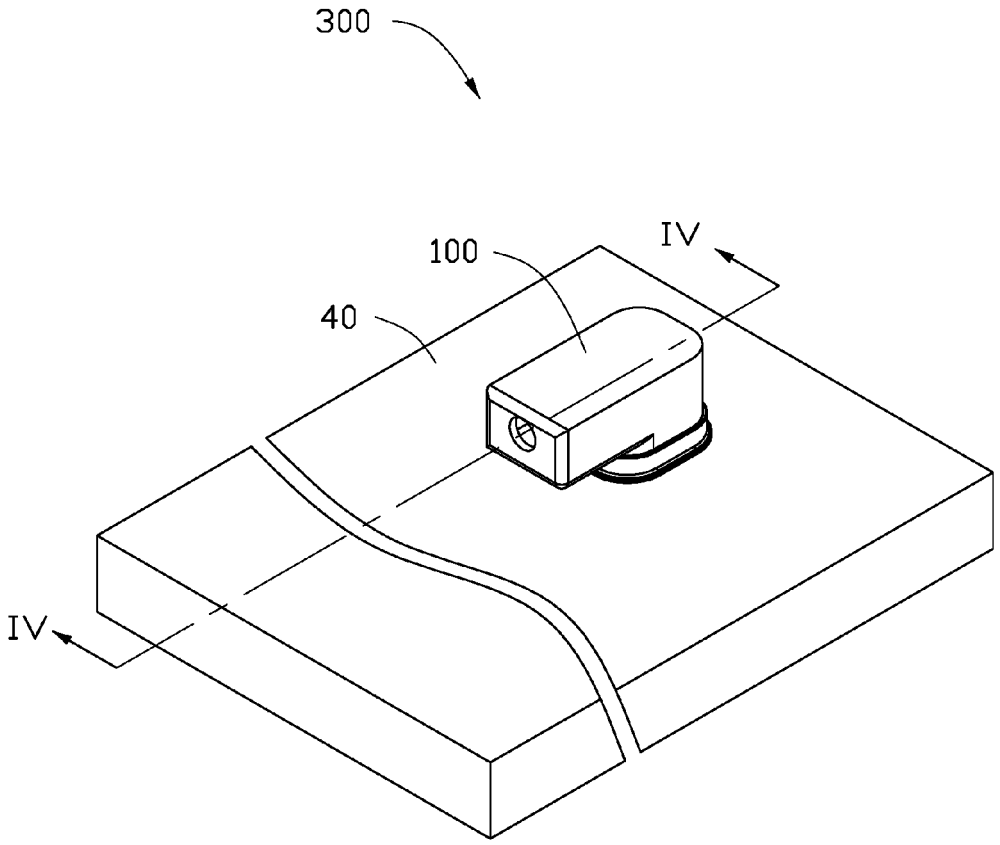
FIG. 3 is an assembled, isometric view of a second embodiment of an electronic device with a loudspeaker module.

FIG. 3 illustrates a second embodiment of an electronic device 300. The electronic device 300 includes a housing 40 and a loudspeaker module 100 mounted to the housing 40.

Figure 4:
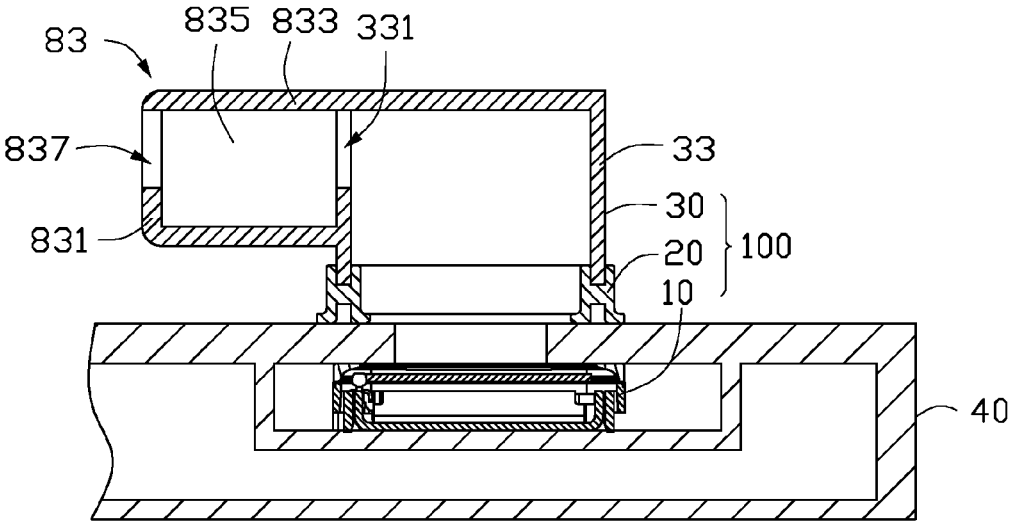
FIG. 4 is a cross-sectional view taken along line IV-IV of FIG. 3.

FIG. 4 illustrates the loudspeaker module 100 includes a loudspeaker 10, a connecting member 20, and a sound box 30. The loudspeaker module 100 differs from the loudspeaker module 50 in that the loudspeaker module 100 further includes an extending member 83 coupled to the sound box 30.

The extending member 83 includes an end wall 831 and a peripheral wall 833. The peripheral wall 833 is perpendicularly coupled to the sidewall 33 defining the sounding output hole 331. The end wall 831 is perpendicularly coupled to the peripheral wall 833 and is parallel to the sidewall 33 defining the sounding output hole 331. The end wall 831, the peripheral wall 833, and the sidewall 33 defining the sounding output pole 331 cooperatively form a resonant cavity 835. The resonant cavity 835 is communicated with the sounding output hole 331 and is configured to receive the sounds from the sounding output hole 331. The end wall 831 further defines an extending hole 837. The extending hole 837 is configured to output the resonated sounds from the resonant cavity 835.

The embodiments shown and described above are only examples. Therefore, many such details are neither shown nor described. Even though numerous characteristics and advantages of the present technology have been set forth in the foregoing description, together with details of the structure and function of the present disclosure, the disclosure is illustrative only, and changes may be made in the details, especially in matters of shape, size and arrangement of the parts within the principles of the present disclosure up to, and including the full extent established by the broad general meaning of the terms used in the claims. It will therefore be appreciated that the embodiments described above may be modified within the scope of the claims.

What is claimed is:

1. An external sound box for an electronic device comprising:

a connecting member with a sound passage, the connecting member selectively attachable to a surface of the electronic device by suction attachment to cover a sounding hole of the electronic device; and a sound box mounted on the connecting member, the sound box defining a resonant chamber communicating with the sound passage and comprising a sound output hole;

wherein, sound generated by the electronic device moves from the sounding hole into the sound passage and the sound box; and wherein, the sound passage and the sound box are configured so that the sound from the sounding hole resonates before exiting the sound output hole with increased volume.

2. The external sound box of claim 1, wherein the sound box comprises a base wall and four sidewalls; the four sidewalls are projected along the outer periphery of the base wall and form the resonant chamber with the base wall; the sounding output hole is defined at one of the four sidewalls.

3. The external sound box of claim 1, wherein the connecting member is made of soft material and comprises a first end and a second end opposite to the first end; the first end defines a mounting slot, the mounting slot is configured to assemble the connecting member to the surface of the electronic device; the second end defines a receiving slot, the four sidewalls are partially received in the receiving slot.

4. A loudspeaker module comprising:

a loudspeaker having at least one sound outlet;

a connecting member with a sound passage, the connecting member selectively attachable to a surface of the electronic device by suction attachment to cover the at least one sound outlet; and a sound box defining a resonant chamber and a sounding output hole, and the sound box mounted to the connecting member in a manner that sound generated by loudspeaker passes through the at least one sound outlet and the sound passage, resonates in the sound passage and the resonant chamber, and leaks from the sounding output hole with increased volume.

5. The loudspeaker module of claim 4, wherein the sound box comprises a base wall and four sidewalls; the four sidewalls are projected along the outer periphery of the base wall and form the resonant chamber with the base wall; the sounding output hole is defined at one of the four sidewalls.

6. The loudspeaker module of claim 5, wherein the connecting member comprises a first end and a second end opposite to the first end; the first end defines a mounting slot, the mounting slot is configured to assemble the connecting member to the surface of the electronic device; the second end defines a receiving slot, the four sidewalls are partially received in the receiving slot.

7. The loudspeaker module of claim 5, further comprising an extending member coupled to the sound box, wherein the extending member comprises an end wall and a peripheral wall; the peripheral wall is perpendicularly coupled to the sidewall defining the sounding output hole, the end wall is perpendicularly coupled to the peripheral wall and is parallel to the sidewall defining the sounding output hole.

8. The loudspeaker module of claim 6, wherein the connecting member is made of soft material.

9. The loudspeaker module of claim 7, wherein the end wall, the peripheral wall, and the sidewall defining the sounding output hole cooperatively form a resonant cavity, the resonant cavity is communicated with the sounding output hole.

10. The loudspeaker module of claim 9, wherein the end wall defines an extending hole, the extending hole is communicated with the resonant cavity.

11. An electronic device comprising:

a housing defining a sounding hole; and a loudspeaker module, the loudspeaker comprising:

a loudspeaker mounted to an interior of the housing;

a connecting member with a sound passage, the connecting member selectively attachable to an exterior of the housing by suction attachment to cover the sounding hole; and a sound box defining a resonant chamber and a sounding output hole, and the sound box mounted to the connecting member in a manner that sound generated by loudspeaker passes through from the sound passage, resonates in the sound passage and the resonant chamber, and leaks from the sounding output hole with increased volume.

12. The electronic device of claim 11, wherein the housing comprises a bottom wall, a top wall, and a connecting wall; the top wall is parallel to and spaced apart from the bottom wall;

the connecting wall is perpendicularly coupled between the outside peripheries of the bottom wall and the top wall; the top wall comprises a first surface and a second surface opposite to the first surface; a receiving cavity protrudes from the first surface towards the bottom wall; the loudspeaker is received in the receiving cavity; the sounding hole is defined at the top wall, the connecting member is mounted to the second surface.

13. The electronic device of claim 11, wherein the sound box comprises a base wall and four sidewalls; the four sidewalls are projected along the outer periphery of the base wall and form the resonant chamber with the base wall; the sounding output hole is defined at one of the four sidewalls.

14. The electronic device of claim 11, wherein the connecting member comprises a first end and a second end opposite to the first end; the first end defines a mounting slot, the mounting slot is configured to assemble the connecting member to the exterior of the housing;

the second end defines a receiving slot, the four sidewalls are partially received in the receiving slot.

15. The electronic device of claim 13, further comprising an extending member coupled to the sound box, wherein the extending member comprises an end wall and a peripheral wall; the peripheral wall is perpendicularly coupled to the sidewall defining the sounding output hole, the end wall is perpendicularly coupled to the peripheral wall and is parallel to the sidewall defining the sounding output hole.

16. The electronic device of claim 15, wherein the end wall, the peripheral wall, and the sidewall defining the sounding output hole cooperatively form a resonant cavity, the resonant cavity is communicated with the sounding output hole.

17. The electronic device of claim 16, wherein the end wall defines an extending hole, the extending hole is communicated with the resonant cavity.

* * * * *